US007578227B1

(12) United States Patent
Jacob

(10) Patent No.: US 7,578,227 B1
(45) Date of Patent: Aug. 25, 2009

(54) FIRE CONTROL MECHANISM FOR SELECTABLE FIRE

(75) Inventor: Adam M. Jacob, Brodheadsville, PA (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 0 days.

(21) Appl. No.: 12/106,624

(22) Filed: Apr. 21, 2008

Related U.S. Application Data

(60) Provisional application No. 60/913,302, filed on Apr. 23, 2007.

(51) Int. Cl.
*F41A 5/00* (2006.01)

(52) U.S. Cl. ..... 89/141; 89/139; 89/140

(58) Field of Classification Search ..... 89/139–141, 89/129.02, 144–146, 149, 150, 154
See application file for complete search history.

(56) References Cited

U.S. PATENT DOCUMENTS 1,387,460 A * 8/1921 Beets ..... 89/184
3,345,914 A * 10/1967 Newcomb et al. ..... 89/129.02
4,450,752 A * 5/1984 Donovan ..... 89/142
4,693,169 A * 9/1987 Beretta ..... 89/129.02
5,251,533 A * 10/1993 Layton ..... 89/142
6,615,527 B1 * 9/2003 Martin ..... 42/69.03
2005/0241470 A1 * 11/2005 Hochstrate et al. ..... 89/142
2007/0180984 A1 * 8/2007 Huther ..... 89/148
2007/0266845 A1 * 11/2007 Polston ..... 89/139

* cited by examiner

*Primary Examiner*—Michael Carone
*Assistant Examiner*—Samir Abdosh
(74) *Attorney, Agent, or Firm*—John Moran

(57) ABSTRACT

A fire control mechanism provides semi-automatic, burst, fully automatic, and safe modes for a firearm. The fire control mechanism includes first, second and third shafts. A hammer is rotatably mounted on the first shaft and biased for rotation about the first shaft in a first direction. An auto sear is mounted on the second shaft and engageable with the hammer. A semi disconnect is mounted on the second shaft and engageable with the hammer. A primary sear is mounted on the third shaft and engageable with the hammer.

17 Claims, 6 Drawing Sheets

FIRE CONTROL MECHANISM FOR SELECTABLE FIRE

CROSS-REFERENCE TO RELATED APPLICATIONS

This application claims the benefit under 35 USC 119(e) of U.S. provisional patent application No. 60/913,302 filed on Apr. 23, 2007, which application is hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to firearms and in particular to selectable fire firearms.

A fire control mechanism refers to the system employed in a weapon to control the operation and firing mode of the weapon. Traditionally, the fire control mechanism may include some combination of a safe mode, where the weapon will not fire, a semi-automatic mode, where the weapon will fire one round each time the trigger is pulled, a burst mode, where the weapon will fire some predetermined number of rounds each time the trigger is pulled, and/or a fully automatic mode, where a trigger pull causes the weapon to fire continuously until either the trigger is released, or the ammunition runs out.

Existing fire control mechanisms are generally designed to work with a specific firearm and are not easily adaptable to new firearm designs. A need exists for a fire control mechanism that may be used in a variety of firearms, with little or no alterations.

SUMMARY OF THE INVENTION

It is an object of the invention to provide a selectable fire control mechanism.

One aspect of the invention is a fire control mechanism comprising a first shaft; a hammer rotatably mounted on the first shaft, the hammer including a detent formed thereon, the hammer being biased for rotation about the first shaft in a first direction; a second shaft substantially parallel with the first shaft; an auto sear mounted on the second shaft and engageable with the hammer detent, the auto sear being biased for rotation about the second shaft in a second direction that is opposite the first direction; a semi disconnect mounted on the second shaft and engageable with the hammer detent, the semi disconnect being biased for rotation about the second shaft in the second direction, the semi disconnect being disposed further from the hammer detent than the auto sear; a third shaft substantially parallel with the first and second shaft; a primary sear mounted on the third shaft and engageable with the hammer detent, the primary sear being biased for rotation about the third shaft in the second direction, the primary sear being disposed further from the hammer detent than the semi disconnect sear; a movable bolt that, when moving rearward, engages the hammer and rotates the hammer in the second direction such that the auto sear engages the hammer detent; a bolt carrier engaged with a rear end of the movable bolt, the bolt carrier, when moving forward, engages the auto sear and rotates the auto sear in the first direction such that the auto sear disengages the hammer detent; a protrusion disposed on a side of the semi disconnect, the primary sear being operable to engage the protrusion such that the semi disconnect rotates in the first direction and disengages the hammer, the primary sear engaging the protrusion as the primary sear rotates in the second direction, the primary sear engaging the protrusion before engaging the hammer.

The fire control mechanism may further comprise a burst cam mounted on the first shaft and selectively rotatable with the hammer; a burst disconnect mounted on the second shaft and engageable with the burst cam and the hammer, the burst disconnect being biased for rotation about the second shaft in the second direction, the burst disconnect being disposed about a same distance from the hammer as the semi disconnect.

A second protrusion may be disposed on a side of the burst disconnect, the primary sear being operable to engage the second protrusion such that the burst disconnect rotates in the first direction and disengages the hammer, the primary sear engaging the second protrusion as the primary sear rotates in the second direction, the primary sear engaging the second protrusion before engaging the hammer.

The fire control mechanism may further comprise at least three spring loaded plungers disposed, respectively, over the auto sear, the semi disconnect and the burst disconnect, the spring loaded plungers providing the bias in the second direction for the auto sear, the semi disconnect and the burst disconnect.

The fire control mechanism may additionally comprise a plurality of spring loaded plungers having first ends fixed in a side of the hammer and second ends bearing on a side of the burst cam, the side of the burst cam include a plurality of detents formed therein for receiving the second ends of the spring loaded plungers to thereby transfer torque from the hammer to the burst cam.

A torsion spring may be disposed on the third shaft to bias the primary sear for rotation about the third shaft in the second direction.

A rotatable selector cam may be disposed adjacent the semi disconnect, the primary sear and the burst disconnect. The selector cam may comprise a first cam surface engageable with the semi disconnect, a second cam surface engageable with the primary sear and a third cam surface engageable with the burst disconnect.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The present invention includes a novel fire control mechanism and method. The invention may be used in any weapon having a hammer, trigger and firing pin. The invention includes a safe mode, semi-automatic mode, burst mode, and automatic fire mode, or any combination of those modes.

Figure 1:
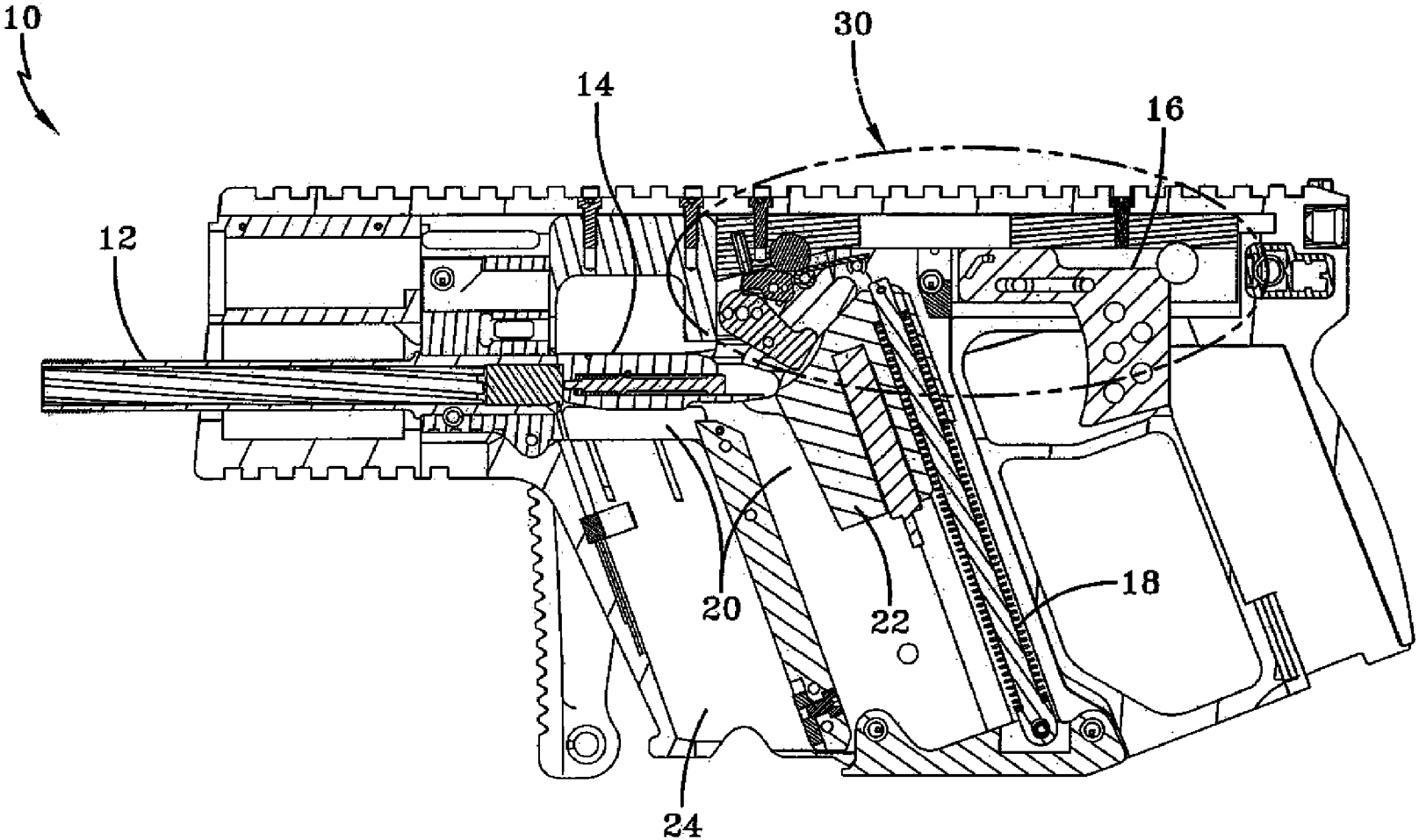
FIG. 1 is a side view, cutaway and partially in section, of an exemplary weapon that incorporates an embodiment of a fire control mechanism in accordance with the invention.

FIG. 1 is a side view, cutaway and partially in section, of an exemplary weapon 10 that incorporates a fire control mechanism in accordance with the invention. The weapon 10 shown in FIG. 1 is a submachine gun. However, the invention is applicable to other types of firearms. Weapon 10 includes a barrel 12, a bolt 14, a trigger 16, a main spring 18, a receiver 20, a bolt carrier 22, and a magazine 24. The fire control components are generally located in the area 30 of FIG. 1

Figure 2:
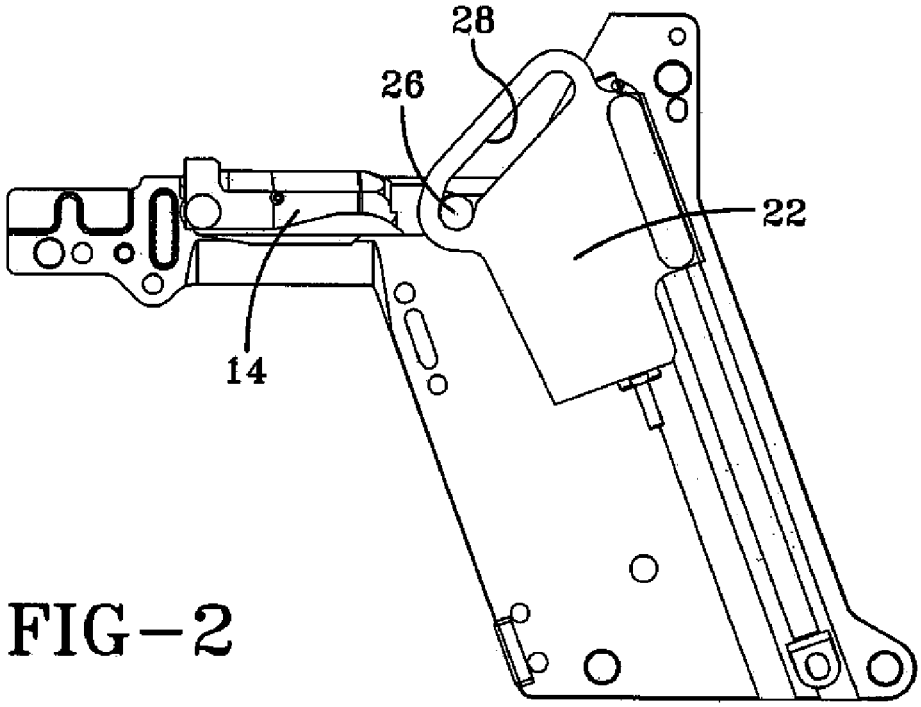
FIG. 2 shows a weapon bolt in a closed position, prior to firing.
Figure 3:
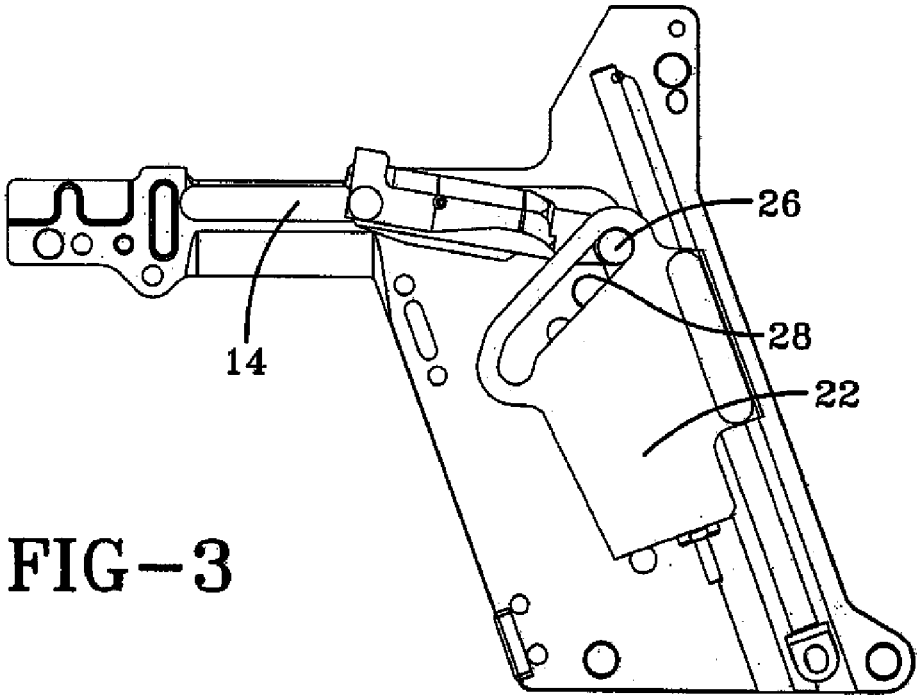
FIG. 3 shows a weapon bolt in a rearward position, after firing.

The weapon 10 functions using the blow back from the ammunition. The blow back causes the bolt 14 to move rearward. FIG. 2 shows the bolt 14 in the closed position, prior to firing. FIG. 3 shows the bolt 14 in its rearward position, after firing. A pair of protrusions 26 on the rear end of the bolt 14 follow cam paths 28 in the bolt carrier 22 as the bolt 14 moves rearward. The weapon main spring 18 (FIG. 1) moves the bolt 14 forward and the bolt carrier 22 upward. The movement of bolt 14 off the axis of barrel 12 forms no part of the present invention and is shown as one example of bolt movement. U.S. Pat. No. 7,201,094 issued to Jebsen et al. disclose a recoil control device that uses off-axis bolt movement and is herein expressly incorporated by reference. Jebsen et al. also disclose a fire control mechanism.

Figure 4:
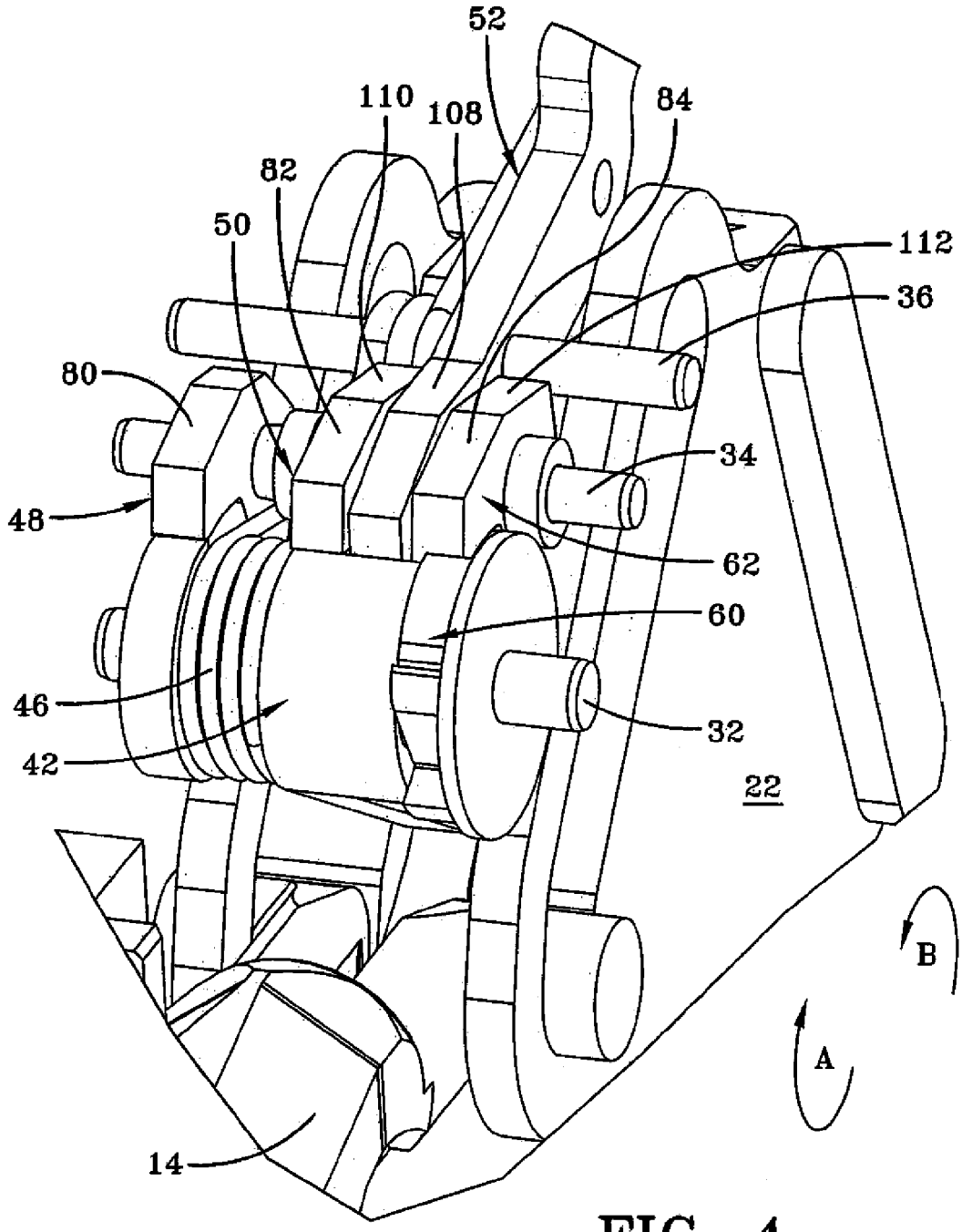
FIG. 4 is a perspective view, viewed from the muzzle end of the weapon, of an embodiment of a fire control mechanism.
Figure 5:
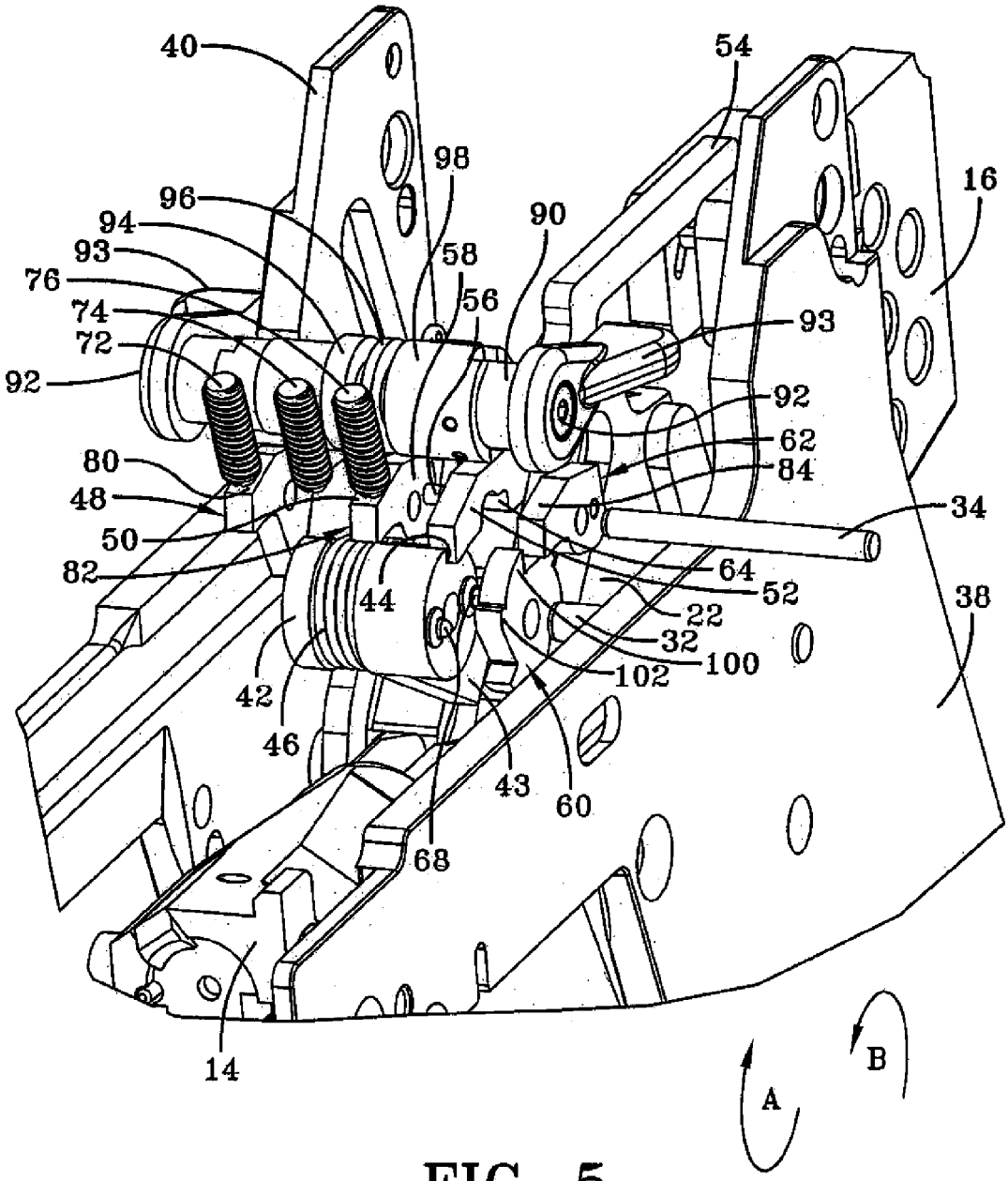
FIG. 5 is an exploded view of FIG. 4, with additional features of the fire control mechanism shown.

FIG. 4 is a perspective view, viewed from the muzzle end of the weapon 10, of an embodiment of a fire control mechanism. FIG. 5 is an exploded view of FIG. 4, with additional features of the fire control mechanism shown. As in known in the art, the receiver 20 (FIG. 1) comprises a pair of receiver plates 38, 40 (FIG. 5) to which the components of the fire control system may be mounted. The fire control mechanism includes first, second and third substantially parallel shafts 32, 34, 36 (FIG. 4). A hammer 42 is rotatably mounted on the first shaft 32. The hammer 42 includes a shoulder or detent 44 (FIG. 5) formed thereon. The hammer 42 is biased for rotation about the first shaft 32 in the direction of arrow A. The bias may be applied by a spring 46. A downwardly extending portion 43 (FIG. 5) of the hammer 42 strikes the firing pin in the rear of bolt 14.

An auto sear 48 is mounted on the second shaft 34 and is engageable with the hammer detent 44. The auto sear 48 is biased for rotation about the second shaft 34 in the direction of arrow B, which is opposite the direction of arrow A. A semi disconnect 50 is mounted on the second shaft 34 and engageable with the hammer detent 44. The semi disconnect 50 is biased for rotation about the second shaft 34 in direction B. The semi disconnect 50 is disposed further from the hammer detent 44 than the auto sear 48, that is, the auto sear 48 will engage the hammer 42 before the semi disconnect 50.

A primary sear 52 is mounted on the third shaft 36 and is engageable with the hammer detent 44. The primary sear 52 is biased for rotation about the third shaft 36 in the direction B. The primary sear 52 is disposed further from the hammer detent 44 than the semi disconnect 50, that is, the semi disconnect 50 will engage the hammer 42 before the primary sear 52. An end 54 of primary sear 52 engages a trigger 16. The primary sear 52 is cut out at 64 so as to not interfere with shaft 34.

The fire control mechanism may further comprise a burst cam 60 mounted on the first shaft 32 and selectively rotatable with the hammer 42. A burst disconnect 62 may be mounted on the second shaft 34 and is engageable with the burst cam 60 and the hammer 42. The burst disconnect 62 is biased for rotation about the second shaft 34 in the direction B. The burst disconnect 62 is disposed further from the hammer detent 44 than the auto sear 48 that is, the auto sear 48 will engage the hammer 42 before the burst disconnect 62. The semi disconnect 50 and the burst disconnect 62 are about a same distance from the hammer 42. When the fire control mechanism is not in the burst mode, the burst disconnect 62 does not engage the burst cam 60 and the burst cam 60 rotates with the hammer 42.

Figure 7:
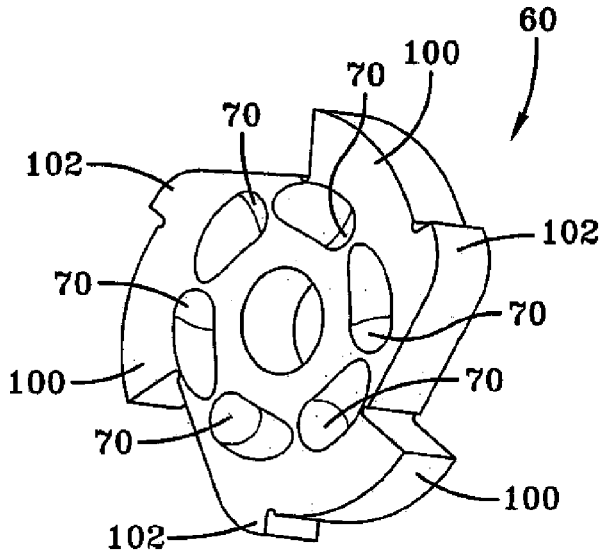
FIG. 7 is a perspective view of a burst cam.

Rotation of the burst cam 60 with the hammer 42 is accomplished by fixing a plurality of spring loaded plungers 68 (FIG. 5) in respective holes in hammer 14. The rounded ends of the plungers 68 rest in corresponding detents 70 (FIG. 7) formed in the side of the burst cam 60. The spring loaded plungers 68 transfer torque from the hammer 42 to the burst cam 60. However, when the burst disconnect 62 engages the burst cam 60, the burst cam 60 is stationary and the rounded ends of the spring loaded plungers 68 slide across the side surface of the burst cam 60.

Figure 6:
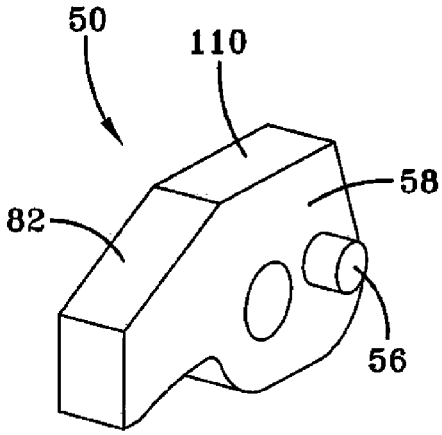
FIG. 6 is a perspective view of a semi disconnect.
Figure 10:
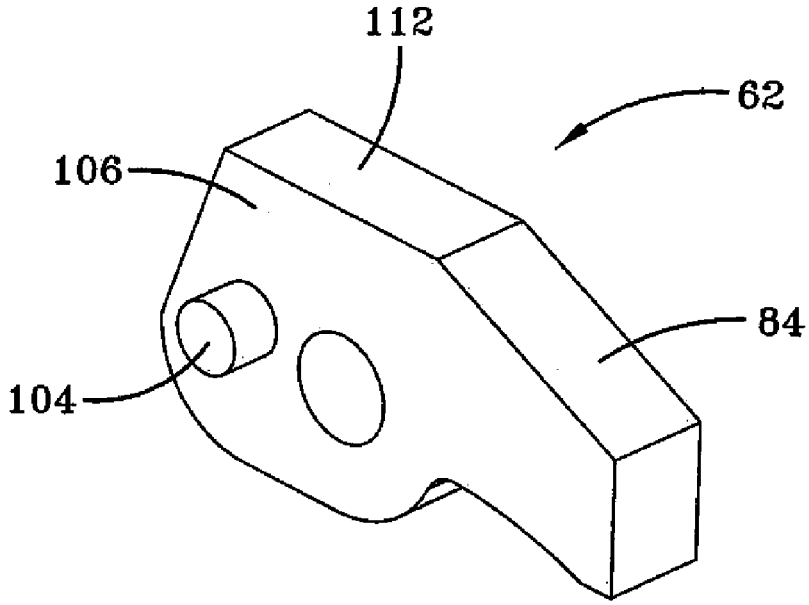
FIG. 10 is a perspective view of a burst cam.

As described above, the auto sear 48, semi disconnect 50 and burst disconnect 62 are all mounted on shaft 34 and biased for rotation in the direction B. One way to bias these three components is to use spring loaded plungers 72, 74, 76 (FIG. 5). The upper ends of the plungers 72, 74, 76 are fixed in a housing that is not shown in FIG. 5. Plungers 72, 74, 76 are located above the auto sear 48, semi disconnect 50 and burst disconnect 62, respectively, such that the ends of the plungers 72, 74, 76 contact surfaces 80, 82, 84 (FIGS. 4 and 5) respectively, of the auto sear 48, semi disconnect 50 and burst disconnect 62. Surface 82 of semi disconnect is also shown in FIG. 6. Surface 84 of burst disconnect 62 is also shown in FIG. 10.

Figure 8:
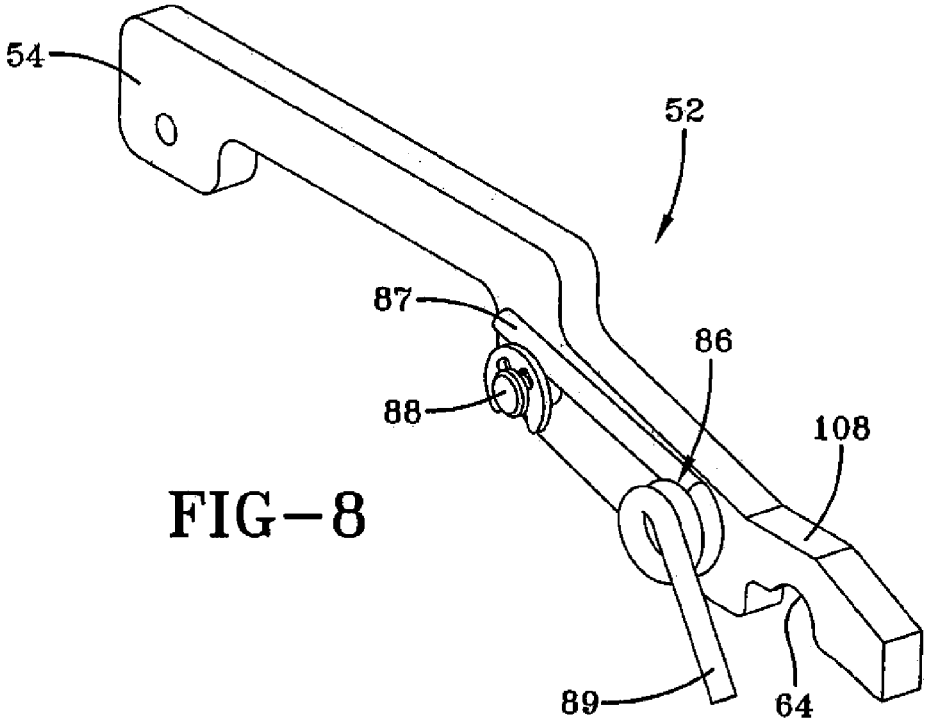
FIG. 8 is a perspective view of a primary sear.

The primary sear 52 may be biased by a torsion spring 86 (FIGS. 4, 5, 8)) having one end 87 fixed to a stub shaft 88 of the primary sear 52, a coiled portion disposed on shaft 36 and a second end 89 fixed to the receiver 20.

Figure 9:
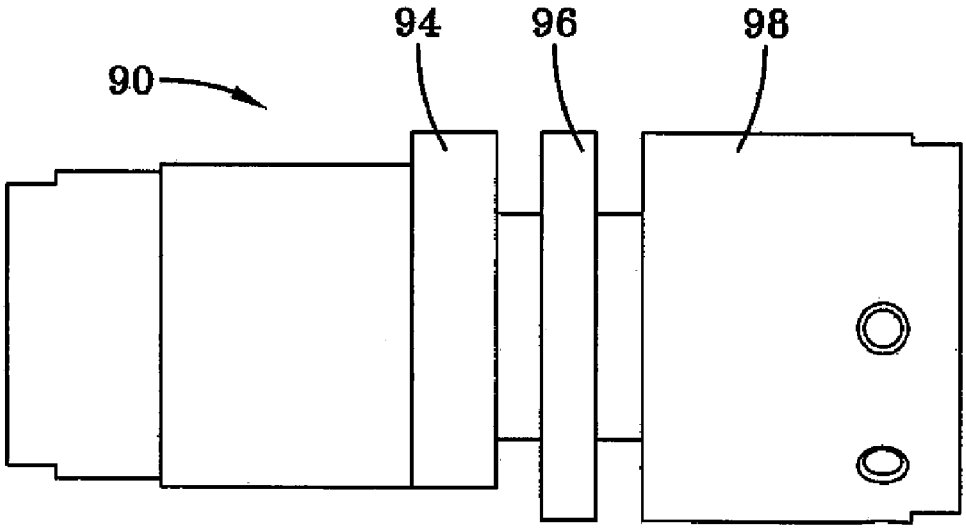
FIG. 9 is a front view of a selector cam.

Firing mode selection may be accomplished using a selector cam 90 (FIGS. 5 and 9). One or both ends of selector cam 90 may include an extension 92 having a thumb tab 93. The user may use his thumb to engage thumb tab 93 and rotate cam 90. Extensions 92 and thumb tabs 93 are not shown in FIG. 9. Selector cam 90 includes cam surfaces 94, 96, 98. In the safe mode, cam 90 is rotated such that the cam surface 96 engages or bears on surface 108 (FIGS. 4 and 8) of the primary sear 52 to prevent it from ever rotating away from the hammer detent 44. In all other modes, the cam surface 96 does not interfere with movement of the primary sear 52. In the semi-automatic mode, cam 90 is rotated such that the cam surface 94 does not contact semi disconnect 50. In the burst mode or the fully automatic mode, cam surface 94 contacts surface 110 (FIGS. 4 and 6) of the semi disconnect 50 to rotate semi disconnect 50 in the direction A away from hammer 42. In the burst mode, cam surface 98 does not contact burst disconnect 62. In modes other than burst mode, cam surface 98 contacts surface 112 (FIGS. 4 and 10) of the burst disconnect 62 and rotates it in the direction A away from burst cam 60.

The trigger 16 (FIG. 5) interacts with the end 54 of the primary sear 52. When the trigger 16 is pulled, the trigger 16 causes the primary sear 52 to rotate in the direction A away from the hammer detent 44. When the trigger 16 is released, the trigger mechanism causes the primary sear to rotate in the direction B toward the hammer 42.

In operation, when the weapon 10 is cocked, the primary sear 52 holds the hammer 42 in the cocked position. When the user pulls the trigger 16, the primary sear 52 (in communication with the trigger mechanism) rotates in direction A and releases the hammer 42. The spring loaded hammer 42 rotates in direction A and strikes the firing pin (not shown). The firing pin strikes the primer on the cartridge, which then fires.

The bolt 14 is pushed back by the cartridge (which is pushed back by the propellants gases). The bolt 14 then pushes against the cam surfaces 28 (FIGS. 2 and 3) of the bolt carrier 22. The bolt carrier 22 moves in a downward direction inside the receiver 20. As the bolt 14 moves back and the bolt carrier 22 moves down (which happens simultaneously, as they are in movable communication with each other), the bolt 14 pushes the hammer 42 back to a position such that the auto sear 48 engages the hammer detent 44.

At this point, the bolt 14 and bolt carrier 22 have traveled to a position sufficient to cock the hammer 42. The bolt 14 and the bolt carrier 22 then continue to cycle, i.e., the bolt 14 continues to travel rearward, while the bolt carrier 22 simultaneously continues to travel downward. When the bolt carrier 22 hits the bottom of the receiver 20, the main spring 18 pushes the bolt carrier 22 back up towards the closed position. During this upward movement of the bolt carrier 22, the bolt carrier 22 pushes the bolt 14 forward. The bolt 14 strips the next cartridge out of the magazine 24 and loads the cartridge into the chamber. The bolt carrier 22, when reaching its final position, contacts the auto sear 48 and causes it to rotate in the direction A, thereby releasing the hammer 42. The above process happens during every fire mode. This process is a single "cycle" of the weapon. The weapon operation is further defined by the particular firing mode of the weapon.

If the weapon 10 is in semi-auto mode, then the selector cam 90 is in a position such that the burst disconnect 62 does not contact the burst cam 60 or the hammer 42. The semi disconnect 50 is in position to interact with the hammer 42, so that the plunger 74 (FIG. 4) causes the semi disconnect 50 to catch the hammer 42 after every firing event. At that point, the trigger 16 is released, causing the primary sear 52 to rotate in direction B. When the primary sear 52 rotates in direction B, the primary sear 52 contacts the small protrusion 56 on the side 58 of semi disconnect 50. The semi disconnect 50 then rotates off of the hammer 42, releasing the hammer 42 and allowing the primary sear 52 to engage the hammer 42. At this point, the trigger 16 must be pulled again to fire a round. The process above is then repeated each time the trigger 16 is pulled.

If the weapon 10 is in burst mode, then the selector cam 90 is in a position such that the cam surface 94 rotates the semi disconnect 50 in the direction A, away from contact with the hammer 42. After the weapon 10 completes a single cycle as described above, the burst mode operates as follows. The burst cam 60 (FIGS. 4, 5, 7) has deep teeth 100 and shallow teeth 102 formed on the periphery thereof. Because the hammer 42 rotates about sixty degrees from its disengagement with the primary sear 52 to striking the firing pin, the teeth 100, 102 on the burst cam 60 are spaced sixty degrees apart. This spacing limits the number of teeth to six. It is possible to design a hammer to have a shorter rotation, for example, 30 degrees, in which case the burst cam could have 12 teeth spaced thirty degrees apart. The following description relates to burst cam 60 with six teeth.

During each shot, the hammer 42 advances the burst cam 60 around the shaft 32 one tooth length (sixty degrees). The burst disconnect 62 engages the burst cam 60 in both the deep teeth 100 and the shallow teeth 102. However, the burst disconnect 62 engages the hammer 42 only when it also engages a deep tooth 100 of the burst cam 60. In essence, the burst cam 60 prevents the burst disconnect 62 from engaging the hammer 42 on intermittent shots (when the burst disconnect engages a shallow tooth 102), depending upon the predetermined number of shots in each burst. When the burst cam 60 reaches a deep tooth 100, the burst disconnect 62 is allowed to engage the hammer 42. The engagement of the burst disconnect 62 with the hammer 42 causes the hammer 42 to not fall. Thus, the trigger 16 must be released, which causes the primary sear 52 to rotate in direction B. The primary sear 52 then engages with a protrusion 104 (FIG. 10) extending from the side surface 106 of the burst disconnect 62. Then, the burst disconnect 62 lifts off of the hammer 42, and the hammer 42 comes to rest on the primary sear 52. Then, the process may be begun again.

When the hammer 42 and the burst disconnect 62 engage a deep tooth 100, the burst ends and the trigger 16 must be released before the next burst may begin. The number of shots per burst is determined by the number of shallow teeth 102 between each deep tooth 100. For the burst cam 60 of FIG. 4, there is one shallow tooth 102 between each deep tooth 100 so that each pull of the trigger 16 results in a two round burst.

In the full automatic mode, the selector cam 90 is in a position to lift off both the burst disconnect 62 and the semi disconnect 50 from the hammer 42. When the trigger 16 is pulled, the primary sear 52 is lifted off of the hammer 42, and the weapon 10 cycles continuously, as neither the semi disconnect 50 or the burst disconnect 62 may contact the hammer 42. In auto mode, then, as long as the trigger 16 is depressed, the hammer 42 continues to fall after being released by the auto sear 48. The process is repeated until the operator releases the trigger 16 and the primary sear 52 engages the hammer 42 (or until ammunition is exhausted).

While the invention has been described with reference to certain preferred embodiments, numerous changes, alterations and modifications to the described embodiments are possible without departing from the spirit and scope of the invention as defined in the appended claims, and equivalents thereof. For example, if one desires a weapon with no burst mode, one may delete the burst cam 60 and burst disconnect 62 and substitute appropriate spacers therein. Or, if the semi-automatic mode is not desired, one may delete the semi disconnect 50. If the fully automatic mode is not desired, one may modify the selector cam 90 such that at least one of the semi disconnect 50 and burst disconnect 62 are always in position to engage the hammer 42. Thus, the invention provides a fire control mechanism that is adaptable to a variety of weapons and firing modes.

What is claimed is:

1. A fire control mechanism, comprising:

a first shaft;

a hammer rotatably mounted on the first shaft, the hammer including a detent formed thereon, the hammer being biased for rotation about the first shaft in a first direction;

a second shaft substantially parallel with the first shaft;

an auto sear mounted on the second shaft and engageable with the hammer detent, the auto sear being biased for rotation about the second shaft in a second direction that is opposite the first direction;

a semi disconnect mounted on the second shaft and engageable with the hammer detent, the semi disconnect being biased for rotation about the second shaft in the second direction, the semi disconnect being disposed further from the hammer detent than the auto sear;

a third shaft substantially parallel with the first and second shaft;

a primary sear mounted on the third shaft and engageable with the hammer detent, the primary sear being biased for rotation about the third shaft in the second direction, the primary sear being disposed further from the hammer detent than the semi disconnect sear;

a movable bolt that, when moving rearward, engages the hammer and rotates the hammer in the second direction such that the auto sear engages the hammer detent;

a bolt carrier engaged with a rear end of the movable bolt, the bolt carrier, when moving forward, engages the auto sear and rotates the auto sear in the first direction such that the auto sear disengages the hammer detent;

a protrusion disposed on a side of the semi disconnect, the primary sear being operable to engage the protrusion such that the semi disconnect rotates in the first direction and disengages the hammer, the primary sear engaging the protrusion as the primary sear rotates in the second direction, the primary sear engaging the protrusion before engaging the hammer.

2. The fire control mechanism of claim 1, further comprising:

a burst cam mounted on the first shaft and selectively rotatable with the hammer;

a burst disconnect mounted on the second shaft and engageable with the burst cam and the hammer, the burst disconnect being biased for rotation about the second shaft in the second direction, the burst disconnect being disposed about a same distance from the hammer as the semi disconnect.

3. The fire control mechanism of claim 2 further comprising a second protrusion disposed on a side of the burst disconnect, the primary sear being operable to engage the second protrusion such that the burst disconnect rotates in the first direction and disengages the hammer, the primary sear engaging the second protrusion as the primary sear rotates in the second direction, the primary sear engaging the second protrusion before engaging the hammer.

4. The fire control mechanism of claim 2 further comprising at least three spring loaded plungers disposed, respectively, over the auto sear, the semi disconnect and the burst disconnect, the spring loaded plungers providing the bias in the second direction for the auto sear, the semi disconnect and the burst disconnect.

5. The fire control mechanism of claim 2 further comprising a plurality of spring loaded plungers having first ends fixed in a side of the hammer and second ends bearing on a side of the burst cam, the side of the burst cam include a plurality of detents formed therein for receiving the second ends of the spring loaded plungers to thereby tmmsfer torque from the hammer to the burst cam.

6. The fire control mechanism of claim 1 further comprising a torsion spring disposed on the third shaft to bias the primary sear for rotation about the third shaft in the second direction.

7. The fire control mechanism of claim 2 further comprising a rotatable selector cam disposed adjacent the semi disconnect, the prirnary sear and the burst disconnect.

8. The fire control mechanism of claim 7 wherein the selector cam comprises a first cam surface engageable with the semi disconnect, a second cam surface engageable with the primary sear and a third cam surface engageable with the burst disconnect.

9. The fire control mechanism of claim 8 wherein, when the second cam surface engages the primary sear, the fire control mechanism is in a safe mode.

10. The fire control mechanism of claim 8 wherein, when the second cam surface does not engage the primary sear, the first cam surface does not engage the semi disconnect, and the third cam surface engages the burst disconnect, the fire control mechanism is in a semi-automatic mode.

11. The fire control mechanism of claim 8 wherein, when the second cam surface does not engage the primary sear, the first cam surface engages the semi disconnect, and the third cam surface does not engage the burst disconnect, the fire control mechanism is in a burst mode.

12. The fire control mechanism of claim 8 wherein, when the second cam surface does not engage the primary sear, the first cam surface engages the semi disconnect, and the third cam surface engages the burst disconnect, the fire control mechanism is in a fully automatic mode.

13. The fire control mechanism of claim 2 wherein the burst cam comprises shallow and deep teeth.

14. The fire control mechanism of claim 13 wherein, when the burst disconnect engages a deep tooth of the burst cam, the burst disconnect also engages the hammer detent.

15. The fire control mechanism of claim 14 wherein the shallow and deep teeth are equally spaced around the burst cam.

16. The fire control mechanism of claim 15 wherein, counting in the second direction around the burst cam, there is at least one shallow tooth after each deep tooth.

17. The fire control mechanism of claim 15 wherein a total number of the shallow teeth and the deep teeth is six and the six teeth are spaced about sixty degrees apart on the burst cam.

* * * * *